United States Patent [19]

Muller et al.

[11] 4,319,412

[45] Mar. 16, 1982

[54] SHOE HAVING FLUID PRESSURE SUPPORTING MEANS

[75] Inventors: Roberto Muller, New York, N.Y.; Antonio M. Sousa, Taunton, Mass.

[73] Assignee: Pony International, Inc., New York, N.Y.

[21] Appl. No.: 81,525

[22] Filed: Oct. 3, 1979

[51] Int. Cl.[3] ..... A43B 13/20; A43B 13/04; A43B 23/28

[52] U.S. Cl. ..... 36/29; 36/32 R; 36/59 C

[58] Field of Search ..... 36/28, 29, 30 R, 3 B, 36/3 R, 59 R, 59 C, 32 R

[56] References Cited

U.S. PATENT DOCUMENTS

| | | | |
|---|---|---|---|
| 4,085,527 | 4/1978 | Riggs | 36/59 C |
| 4,161,828 | 7/1979 | Benseler et al. | 36/59 C |

FOREIGN PATENT DOCUMENTS

| | | | |
|---|---|---|---|
| 1287477 | 1/1969 | Fed. Rep. of Germany | 36/29 |
| 2813958 | 10/1979 | Fed. Rep. of Germany | 36/28 |
| 2006270 | 12/1969 | France | 36/29 |
| 16240 | of 1893 | United Kingdom | 36/29 |

*Primary Examiner*—James Kee Chi

*Attorney, Agent, or Firm*—Steven H. Bazerman

[57] ABSTRACT

A shoe of the inflatable type having a midsole supporting member with a number of hollow downwardly extending support posts intercommunicated by channels recessed in the upper surface of the member. The upper surface is covered with a layer of natural rubber, to form enclosed air spaces with the hollows of the posts, and (in cooperation with the channels) conduits providing restricted passageways interconnecting the hollows of the posts. A valve extends from the exterior surface of the heel of the shoe to permit inflation by injection of air into the posts and conduits.

8 Claims, 9 Drawing Figures

FIG.1c
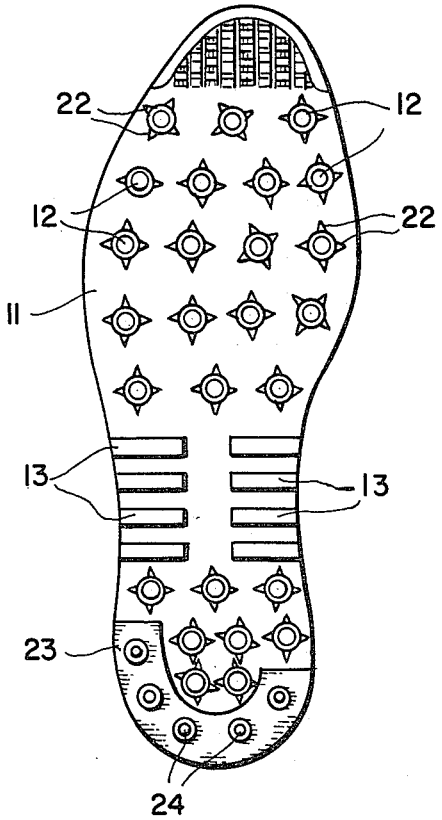
FIG.1d
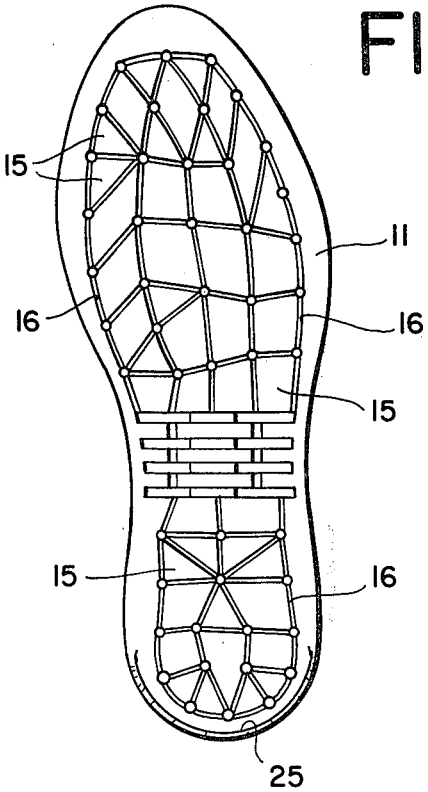
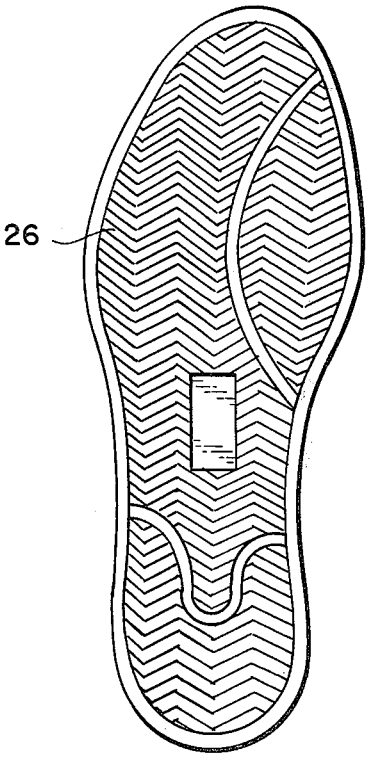
FIG.2b

SHOE HAVING FLUID PRESSURE SUPPORTING MEANS

This invention relates to a shoe having fluid pressure supporting means.

Various types of inflatable shoes are known in the art, as exemplified by U.S. Pat. Nos. 572,887, 1,148,376, 1,639,381, 2,682,712, 580,501, 1,056,426, 2,863,230 and 3,120,712, and British Pat. No. 7507. None of these inflatable or air-cushioned shoes, however, has proven commercially successful. Reasons for commercial impracticability of these prior art shoes include difficulty of fabrication, expense, poor reliability, and questionable improvement in performance over conventinal shoes.

Accordingly, an object of the present invention is to provide an improved shoe having fluid pressure supporting means therein, and overcoming one or more of the aforementioned difficulties exhibited by prior art shoes of this type.

As herein described, there is provided a shoe having fluid pressure supporting means, comprising: a resilient midsole supporting member having (i) a plurality of hollow downwardly depending support posts, the hollows of said posts opening to the upper surface of said member, and (ii) a series of intercommunicating channels formed in said upper surface and communicating with said hollows; a resilient fluid containing member secured to and covering the upper surface of said midsole and cooperating with said channels to form corresponding conduits for permitting restricted passage of fluid between the hollows of said posts; valve means for introducing a compressible fluid into said conduits and hollows; a midsole disposed on the upper surface of said fluid containing member; and an insole disposed on the upper surface of said midsole. IN THE DRAWINGS FIG. 1*a* is a partially cutaway left side view of a shoe according to a preferred embodiment of the present invention;

FIG. 1*b* is a cross-sectional view of a portion of the midsole supporting member of the shoe shown in FIG. 1*a*

FIG. 1*c* is a bottom plan view of the shoe shown in FIG. 1*a;*

FIG. 1*d* is a top plan view of the upper surface of the midsole supporting member of the shoe shown in FIG. 1*a;*

FIG. 2*a* is a partially cutaway left side view of a shoe according to an alternative embodiment of the invention;

FIG. 2*b* is a bottom plan view of the shoe shown in FIG. 2*a;*

FIG. 4 is a perspective view of the midsole supporting member of the shoes shown in FIGS. 1*a* and 2*a.

Figures 1A, 1B:
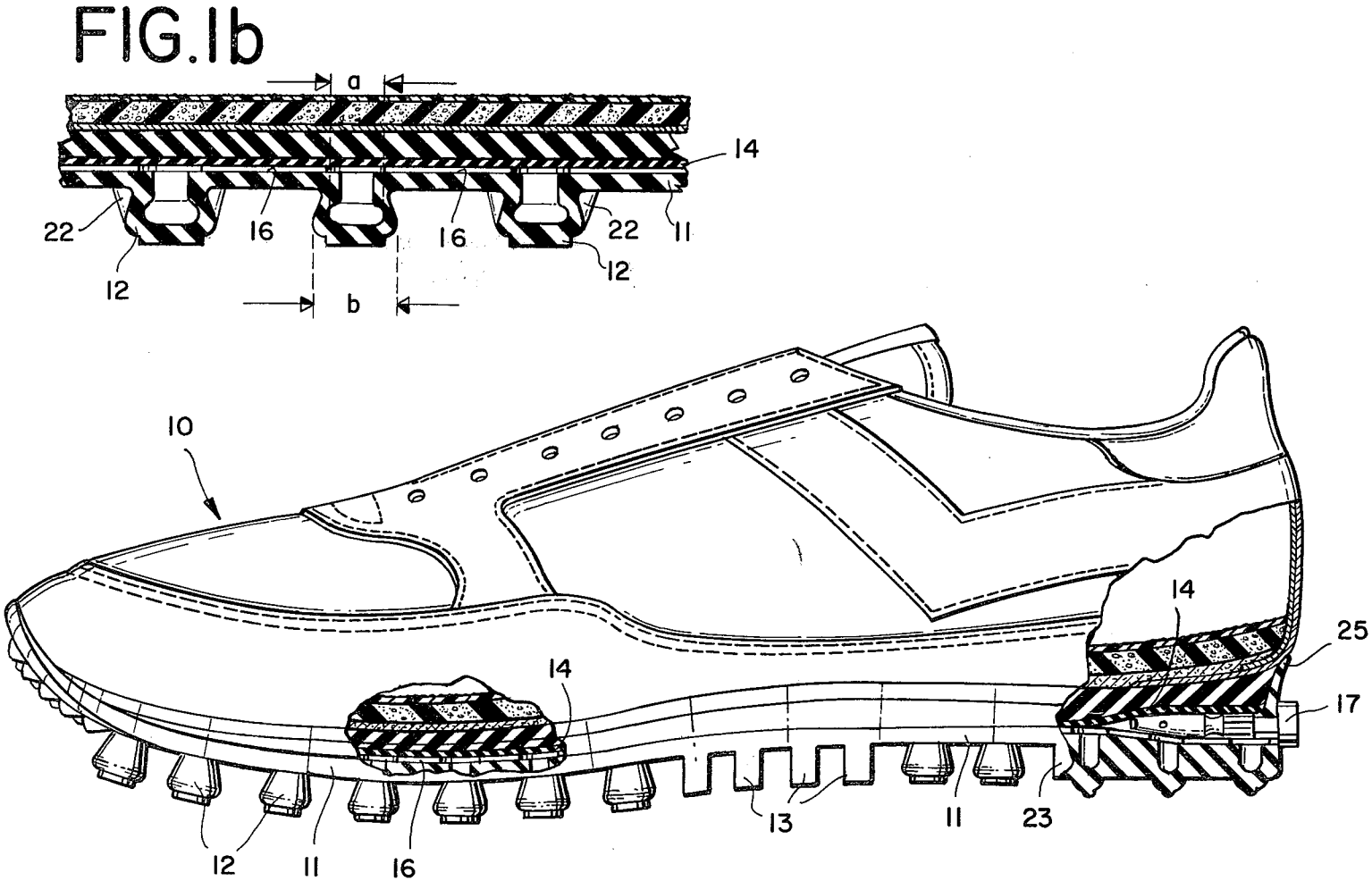

A running shoe 10, as shown in FIG. 1*a*, comprises a midsole supporting member 11 having a plurality of hollow downwardly depending support posts 12 and some hollow downwardly depending laterally elongated support posts 13, all of said support posts being hollow, with the entire supporting member 11 (including the posts 12 and 13) comprising a molded resilient material such as composition rubber.

A resilient fluid containing sheet 14 of natural rubber is bonded to the upper surface of the midsole supporting member 11.

Figure 5:
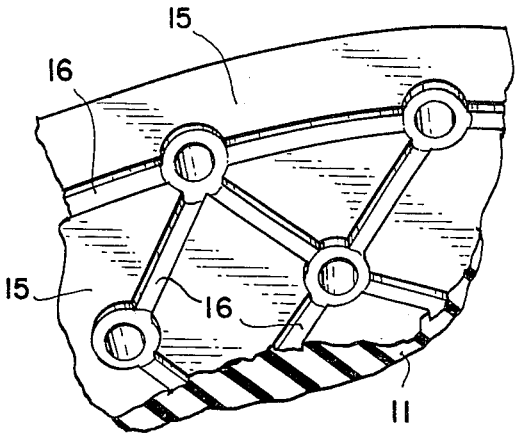
* and FIG. 5 is an enlarged perspective view of a portion of the supporting member shown in FIG. 4.
Figure 4:
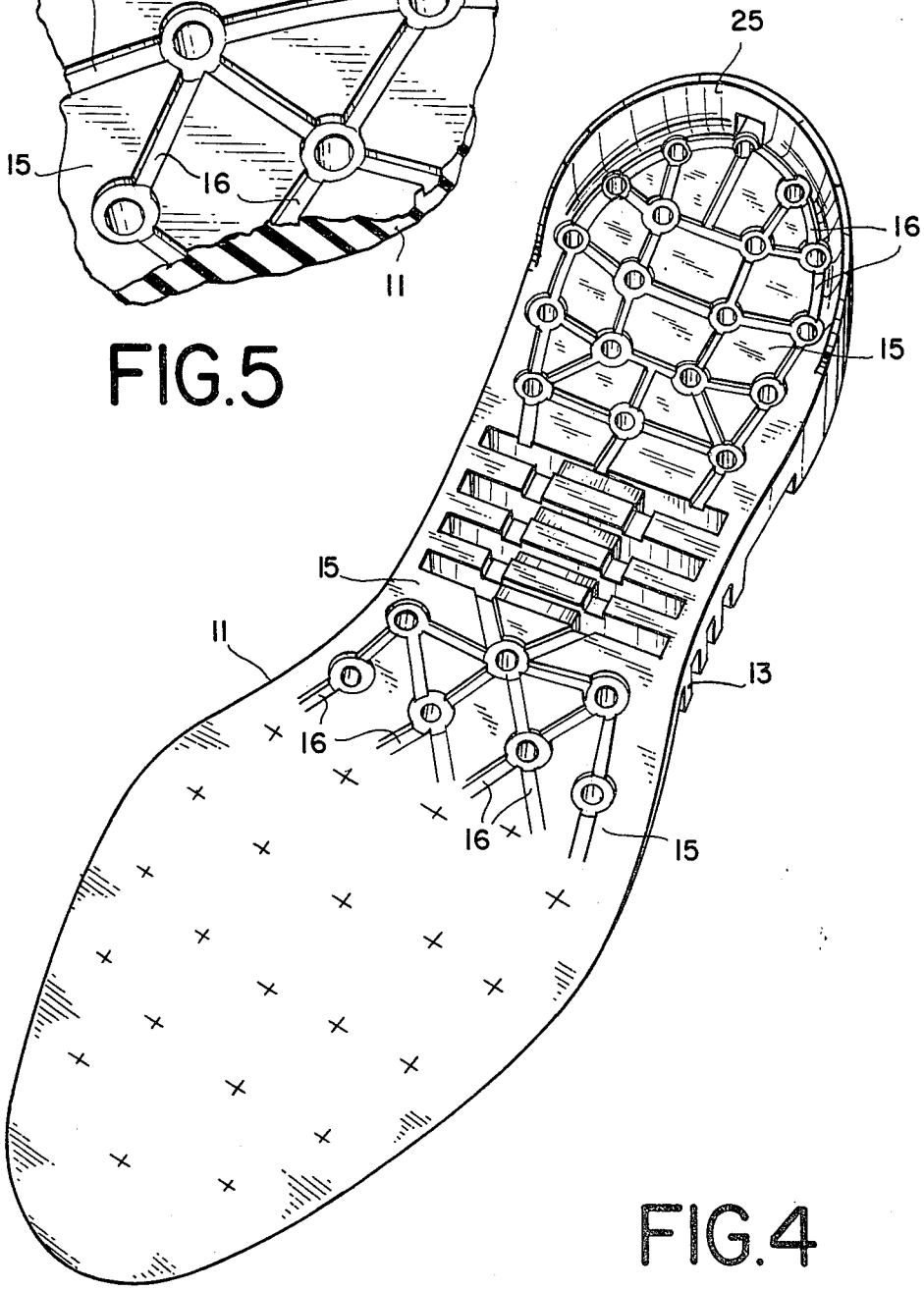

As best seen in FIGS. 4 and 5, the midsole supporting member 11 (which also serves as the treadpiece of the shoe 10) has a plurality of recesses or hollows extending from its upper surface 15 to the hollow interiors of the posts 12 and 13, and interconnecting channels 16 recessed into the surface 15 and communicating with said hollows.

In assembling the shoe, the fluid containing sheet 14 is bonded (by means of any suitable rubber adhesive) to the upper surface 15 of the midsole supporting member 11, in such a manner that the sheet 14 cooperates with the surface 15 to form, in cooperation with the channels 16, conduits for permitting restricted passage of air or another compressible fluid between the hollows of the posts 12 and 13.

The depth of the channels 16 below the surface 15 should be sufficiently great so that said channels are not likely to become clogged by seepage of adhesive when the sheet 14 is bonded to the surface 15. At the same time, the depth of the channels 16 should be sufficiently small so that there is substantial restriction of air flow through them.

The purpose of making the channels 16 sufficiently shallow so that (in cooperation with the sheet 14) restrictive conduits are formed, is to insure that when some of the posts 12 or 13 are compressed or distorted due to the wearer's weight while running or walking, the rate at which air or other fluid is expelled therefrom through the adjacent conduits, is limited by the restrictions thereof, thus producing a "shock absorber" effect.

We have found that it is preferable for the depth of the channels 16 to be in the range of 0 to 1.5 mm to provide an acceptable compromise between considerations of blockage by leakage of adhesive and maintaining sufficient restriction to produce the desired "shock absorber " effect.

The height of the posts 12 and 13 should preferably be in the range of $\frac{1}{4}$ to $\frac{1}{2}$ inch. As seen in FIG. 1*b*, the lower portions of the posts 12 are enlarged to provide additional fluid reservoir capacity. Preferably, the internal diameter a of each of the posts 12 should be in the range of $\frac{1}{4}$ to 1 inch, and the outer diameter thereof should be in the range of $\frac{1}{4}$ to 2 inches.

Figure 3:
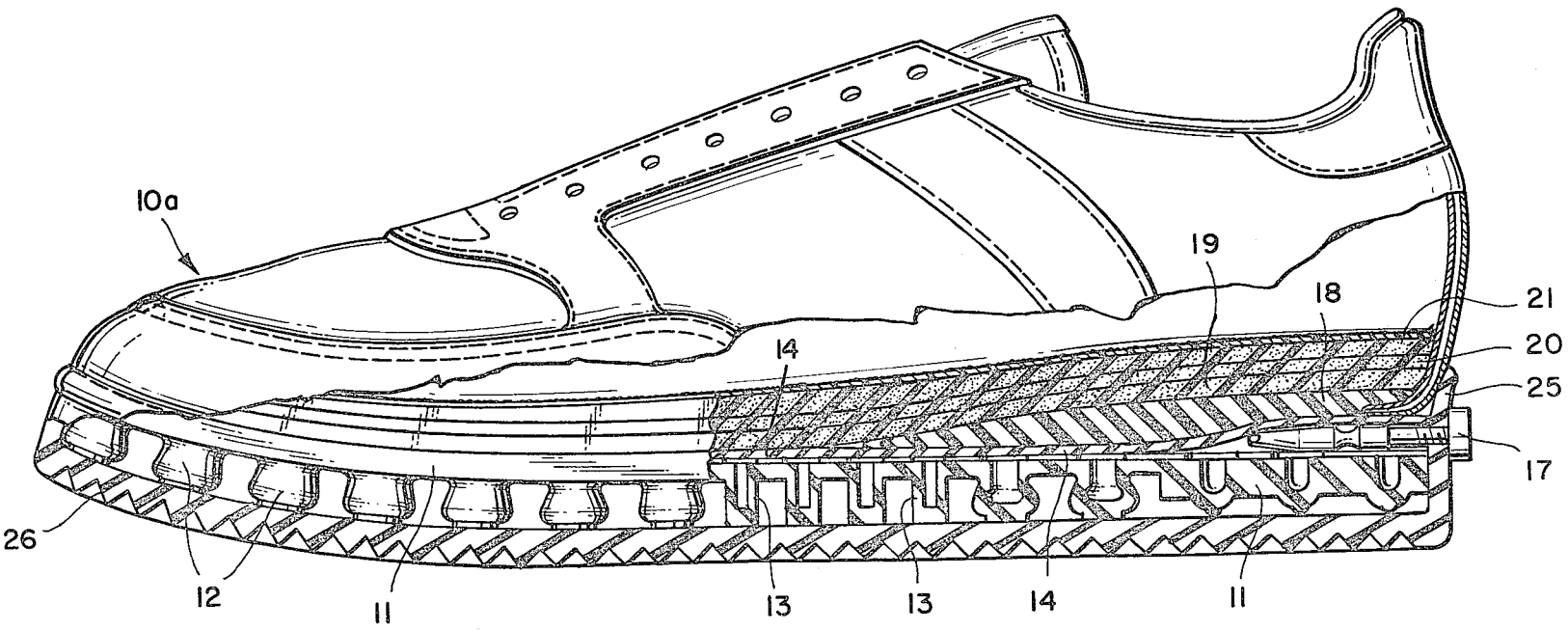
FIG. 3 is a left side cross-sectional view of the shoe shown in FIG. 2*a;*

As seen in FIGS. 1*a* and 3, air or another compressible fluid may be introduced into the arrangement of posts 12 and 13 and channels 16 by means of a valve 17, which may be similar to the valve provided for inflation of a football or basketball.

While the inflation pressure is not critical, it is preferable that the posts 12 and 13 and channels 16 be inflated to a pressure in the range of 12 to 24 psi.

In addition to providing a "shock absorber" effect and resultant improved cushioning action of the wearer's foot, the shoe 10, by limiting contact area between the midsole supporting member 11 and the ground to the bottoms of the posts 12 and 13, provides a substantial reduction of heat transfer to the wearer's foot, so that foot comfort is greatly improved in warm weather.

A midsole comprising layers 18, 19 and 20 (FIG. 3) is disposed on the upper surface of the fluid containing member 14, in order to provide additional cushioning action, and compensation for variations from the desired foot supporting contour. The layers 18, 19 and 20 preferably comprise natural sponge rubber, as does the fluid containing sheet 14.

Disposed on the upper surface of the top midsole layer 20 is an insole or "foot sock " layer 21, also comprising sponge rubber with a layer of a suitable fabric such as nylon bonded to the upper surface thereof.

A suitable arch support of natural rubber is disposed between the midsole layer 20 and insole 21.

As seen in FIG. 1*c*, undesirable lateral (front to rear and left to right) deflection of the post 12 is resisted by molded rubber support flanges 22 extending between the sides of each post and the bottom surface of the midsole supporting member 11. Preferably, three or more support flanges 22 are provided for each of the posts 12.

In order to provide somewhat more firm support for the heel of the shoe, a ridge 23 extends downward from the heel portion of the midsole supporting member 11, and a plurality of relatively small "dimples " 24 extend downward from said ridge to engage the ground.

In order to strengthen the heel portion of the supporting member 11 and facilitate manufacture and assembly of the shoe, an integral raised heel wall 25 (FIG. 3) is provided, with the valve 17 being accessible through a hole in said wall.

Figure 2A:
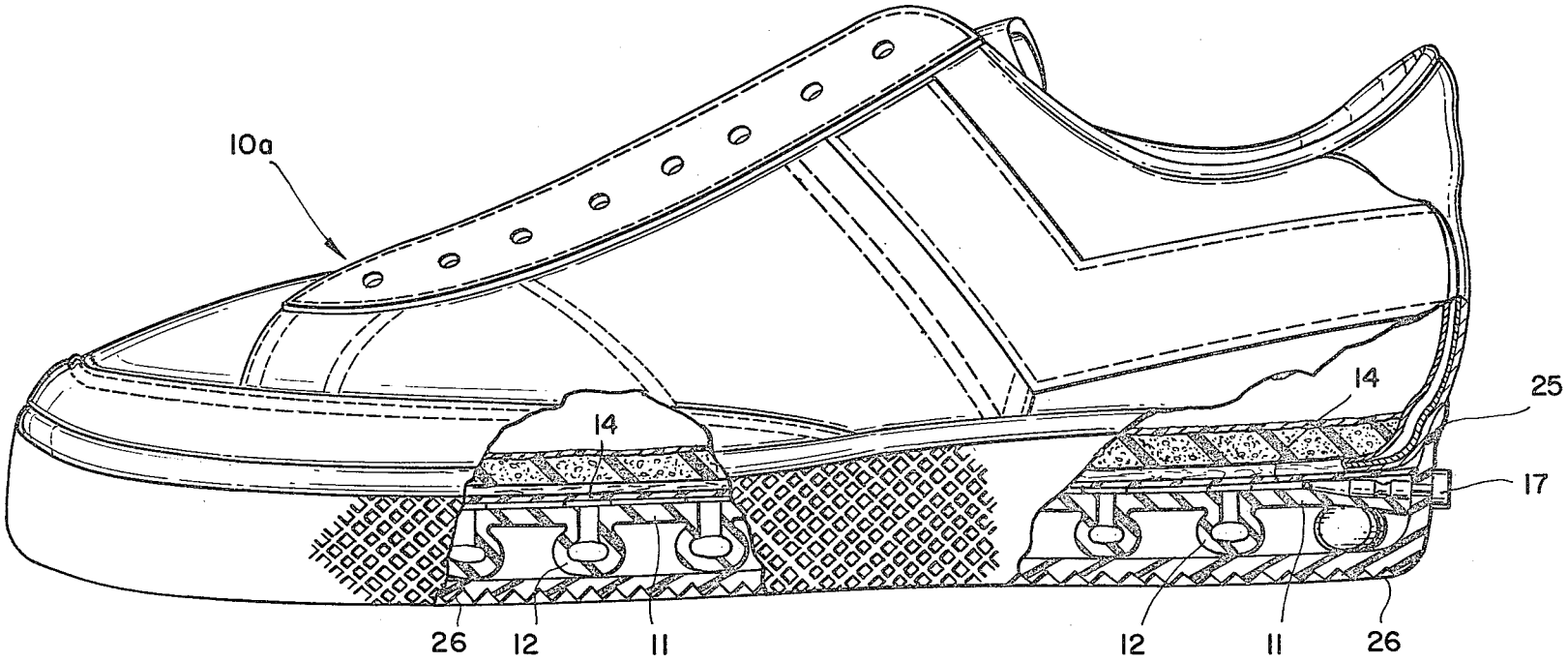

The shoe 10*a* shown in FIG. 2*a* is of similar construction to the shoe 10, except that the posts 12 and 13 and dimples 24 of the midsole supporting member 11, are supported by the upper surface of a treadpiece 26, to facilitate use of the shoe for sports activities such as tennis and basketball. In this shoe, it is desirable to bond the bottoms of the posts 12 and 13 and dimples 24 to the upper surface of the treadpiece 26, in order to eliminate undesirable friction therebetween. Since as a result of such bonding, it is necessary for the posts 12 and 13 to deflect laterally (primarily to the front and rear), the supporting flanges 22 provided for the shoe 10 are eliminated.

Tests conducted by the applicants have shown that the shoes 10 and 10*a* are susceptible of manufacture by mass production techniques (with a roller used to apply adhesive to the upper surface 15 of the supporting member 11, so that adhesive is not applied to the channels 16), to be comfortable, and to exhibit improved foot fatigue characteristics when running or walking.

What is claimed is:

1. A shoe having fluid pressure supporting means, comprising:

a resilient midsole supporting member having (i) a plurality of hollow downwardly depending support posts, the hollows of said posts opening to the upper surface of said member, and (ii) a series of intercommunicating channels formed in said upper surface and communicating with said hollows;

a resilient fluid containing member secured to and covering the upper surface of said midsole and cooperating with said channels to form corresponding conduits for permitting restricted passage of fluid between the hollows of said posts;

valve means for introducing a compressible fluid into said conduits and hollows;

a midsole disposed on the upper surface of said fluid containing member; and an insole disposed on the upper surface of said midsole.

2. The shoe of claim 1, where at least some of said posts have an enlarged lower portion.

3. The shoe of claim 1, further comprising means for reinforcing said posts against lateral deflection.

4. The shoe of claim 2, wherein the internal diameter of each of said lower portions of said posts is in the range of about $\frac{1}{4}$ to 1 inch, and the external diameter thereof is in the range of about $\frac{1}{4}$ to 2 inches.

5. The shoe of claim 1, wherein said midsole comprises natural sponge rubber.

6. The shoe of claim 1, wherein the depth of each of said channels is in the range of about 0.5 to 1.5 millimeter.

7. The shoe of claim 1, wherein said posts are resiliently laterally deflectable, further comprising a tread piece having an upper surface secured to the bottom surfaces of said posts.

8. The shoe of claim 1, wherein at least some of said posts are laterally elongated.

* * * * *

UNITED STATES PATENT AND TRADEMARK OFFICE

CERTIFICATE OF CORRECTION

PATENT NO. : 4,319,412

DATED : March 16, 1982

INVENTOR(S) : Roberto Muller

It is certified that error appears in the above—identified patent and that said Letters Patent is hereby corrected as shown below:

Claim 2, line 1, "where" should read "wherein."

Signed and Sealed this

*Seventh* Day of *September 1982*

[SEAL]

*Attest:*

GERALD J. MOSSINGHOFF

*Attesting Officer*

*Commissioner of Patents and Trademarks*